United States Patent [19]

Lehmann et al.

[11] 4,037,535

[45] July 26, 1977

[54] HIGH SPEED PRINTING APPARATUS

[75] Inventors: Jerry Hans Lehmann, Rochester; Richard L. Mills, Pittsford; William H. Mowry, Jr., Ionia; James D. Peglow, Canandaigua; Norman H. Preston, Rochester; Aniel G. Sitole, Pittsford, all of N.Y.

[73] Assignee: Burroughs Corporation, Detroit, Mich.

[21] Appl. No.: 640,194

[22] Filed: Dec. 12, 1975

Related U.S. Application Data

[63] Continuation of Ser. No. 499,560, Aug. 22, 1974, abandoned.

[51] Int. Cl.[2] ..... B41F 1/28; B41F 1/34

[52] U.S. Cl. ..... 101/287; 101/93; 101/233; 197/173; 271/245; 271/253

[58] Field of Search ..... 101/287, 45, 57, 90, 101/93, 93.08, 93.12, 93.37, 93.41, 93.42, 232, 233, 239, 242, 273; 271/236, 238, 240, 245, 253, 254; 197/173

[56] References Cited

U.S. PATENT DOCUMENTS

| | | | |
|---|---|---|---|
| 2,841,076 | 7/1958 | Johnson et al. | 101/233 |
| 3,242,859 | 3/1966 | Argerinos et al. | 101/407 R |
| 3,254,595 | 6/1966 | Sparrow et al. | 101/287 |
| 3,489,084 | 1/1970 | Strickland et al. | 101/287 |
| 3,575,108 | 4/1971 | Scranton | 101/269 X |
| 3,877,696 | 4/1975 | Miciukiewicz | 271/236 X |
| 3,902,411 | 9/1975 | Gardner et al. | 101/273 X |
| 3,948,170 | 4/1976 | Ericsson | 101/232 X |

*Primary Examiner*—Edgar S. Burr
*Assistant Examiner*—R. E. Suter
*Attorney, Agent, or Firm*—Carl Fissell, Jr.

[57] ABSTRACT

The disclosure relates to item or document signing apparatus for imprinting a legally acceptable signature and/or date, etc., upon individual items or documents fed on demand thereto at high speed from an input to an output hopper in a stop-start operation. An adjustably positionable item stop mechanism permits the printing of the data at selectable locations along the longer dimension of the item. Both date and signature imprinting means are simply efficiently and easily demountably removable and replaceable permitting alteration and/or rapid change of the imprinted data. Novel to be automatically maintained regardless of document thickness.

5 Claims, 30 Drawing Figures

| |
|---|
| FIG. 4. |
| FIG. 5. |

| | |
|---|---|
| FIG.6. | FIG.7. |

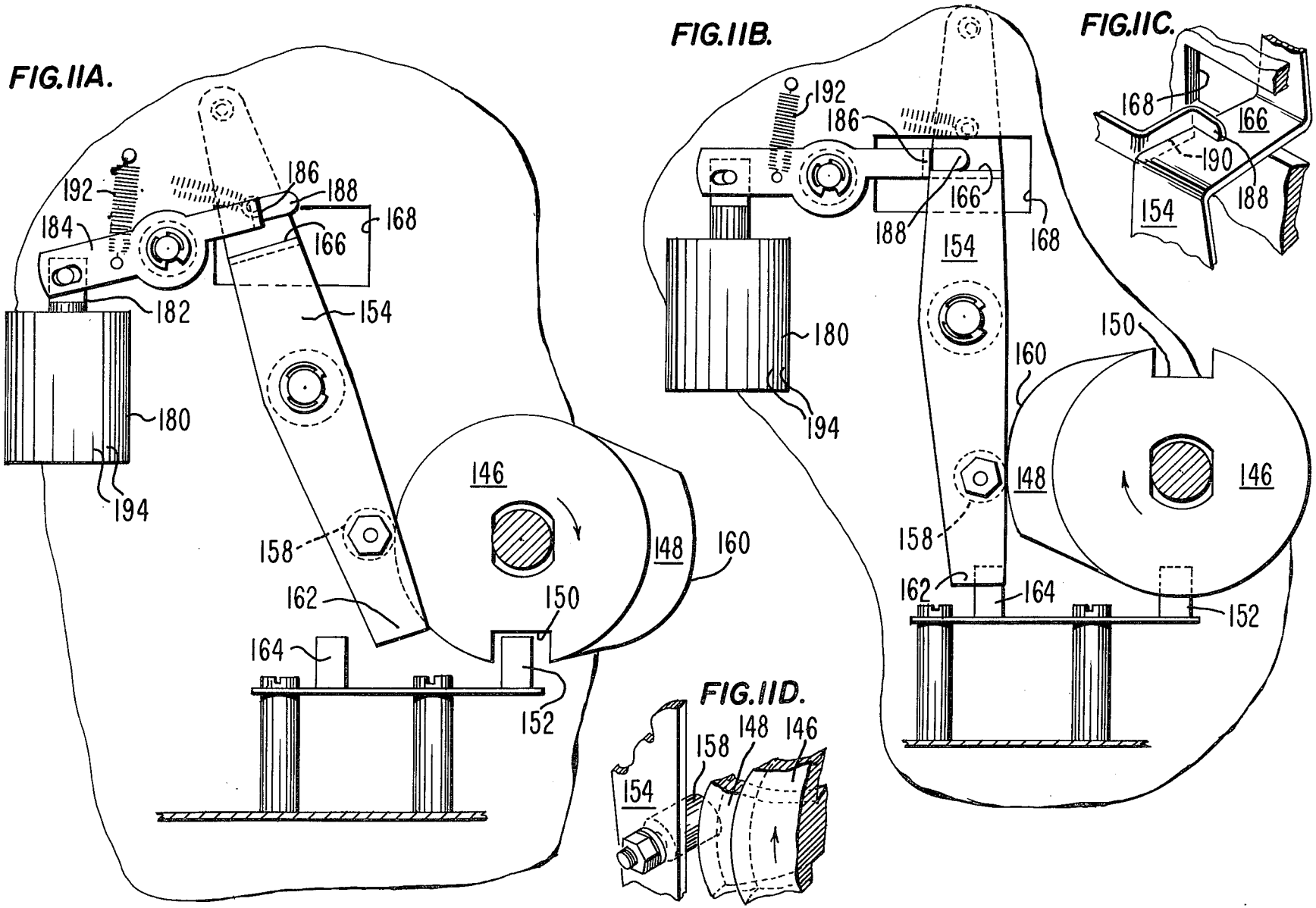
FIG.IIC.
FIG.IIB.
FIG.IID.
FIG.IIA.
146
148
150
152
154
158
160
162
164
166
168
180
182
184
186
188
190
192
194

HIGH SPEED PRINTING APPARATUS

This is a continuation, of application Ser. No. 499,560, filed 8/22/74 now abandoned.

CROSS REFERENCE TO RELATED APPARATUS

The present apparatus employs a high speed, electromechanically actuatable clutch mechanism similar to the apparatus described and claimed in U.S. Pat. No. 3,802,540, Ser. No. 317,090, filed Dec. 20, 1972, issued Apr. 9, 1974, in the names of Norman H. Preston and Henry M. Korytkowski for "ADJUSTABLE STOP COLLAR FOR SPRING CLUTCH".

BACKGROUND OF THE INVENTION

Checkwriters employing multiple platens for printing both individual amounts and the signature of the payee are known. Apparatus of this type generally employ an inking ribbon for inking the printing characters and/or signature plates or platens. Machines are also known for imprinting the MICR (Magnetic Ink Character Recognition)encoding data on individual items or documents such as checks. However, all of the foregoing are limited as to efficiency and/or ease and speed of operation in one regard or another. For example, those checkwriters or signers which are operated electrically or semi-automatically are relatively slow and usually are hand fed. If the MICR encoding data is required to be changed it must be altered by hand. None of the known machines or apparatus operate at relatively high speed and many suffer due to degraded printing which results from the form of print character type used therewith.

Also, in known machines, since the printing area is fixed, variations in document length or size necessitate operator intervention and machine adjustment in order to print the desired signature at the required location on the document, if such location varies from the fixed standard. This usually requires that the printing plate be moved and also the platen which is employed therewith, or that the control stop for the document be positionally altered at the time of manufacture so as to change the location of the signature impression on the document.

Consecutive item MICR number imprinting at the present time can only be performed on a high speed printing press and even then it requires costly and time consuming alteration and adjustment of the apparatus.

The present invention solves the foregoing problems in a unique, novel, unobvious and heretofore unknown manner. The apparatus of the present invention produces high speed signature imprinting and/or dating at any desired location within a wide range of locations by means of an adjustable item stop member which can be adjustably positioned as desired. The stop member is automatically interposed in the pathway of the incoming document to positively stop the document at a precise predetermined location after which a printing impression is automatically accomplished. The document stop is thereafter retracted automatically out of the path of movement of the document permitting the document to be fed into an output or receiving hopper.

Means is provided in the present apparatus for causing the platen or back up anvil against which the signature and/or date plates engage to make a substantially flat or planar contact throughout the entire surface area thereof effective to produce printing comparable to that attained with a typical high speed printing press.

Pressure overload relief means is provided to accommodate multiple documents or documents of varying thickness and/or weight effectively preventing equipment jamming or motor stall due to excessive loading.

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings.

BRIEF DESCRIPTION OF THE DRAWINGS

In the drawings:

FIGS. 11A and 11B are greatly enlarged motion views of the cam-actuated, solenoid latching mechanism for the item stop member;

FIG. 11C is a greatly enlarged detail view of the latch device;

FIG. 11D is a greatly enlarged detail view of the cam-and-follower mechanism of FIGS. 11A and 11B;

DESCRIPTION OF THE PREFERRED EMBODIMENT

Apparatus embodying the present invention is generally of rectangular box-like configuration and functionally is divided into a number of unitary structures interconnected to form a modular assembly. The apparatus is capable of being operated either from the right hand or the left hand side (when viewed from the front) depending upon the desired configuration. If the document, e.g., a check, utilizes a so-called "left hand stub" then such checks would be fed from the left hand side of the machine and the input hopper assembly would be attached to the left hand side of the base machine frame. On the other hand, if the document employs a "right hand stub", then the documents are fed from the right hand side of the machine and the input hopper would necessarily be demountably secured to the right hand side frame of the base structure.

Basically the apparatus is adapted for imprinting a signature and a date on commercial or other similar documents which variously include checks, drafts, money orders and the like. However, it is to be understood that with suitable configuration the machine could be employed to sign a wide variety of different types of items as well as to imprint consecutive MICR encoding on such documents. For the purposes of the present description, however, the document or item to be employed will be considered to be a check, since the check items is the most common of the many items which can be utilized with this apparatus. Generally speaking, such items are of paper and it is to such paper documents that the operation of the machine will be directed. However, assuming that some other form of a document is employed and provided that the surface of such other document is capable of receiving the impression from a printing plate, then obviously the disclosure is not limited to paper documents per se.

Figure 1:
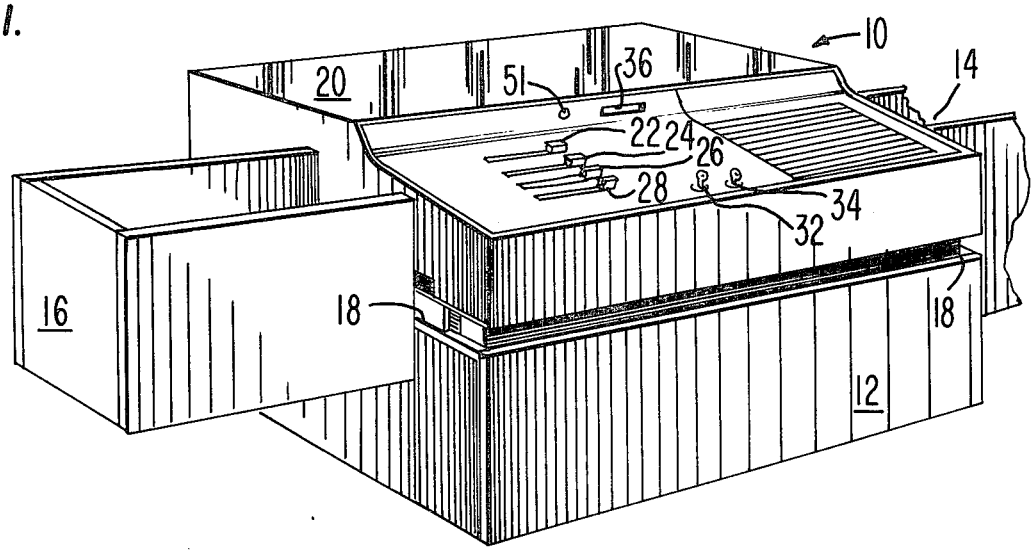
FIG. 1 is a perspective view of a preferred embodiment of the present invention.
Figure 2:
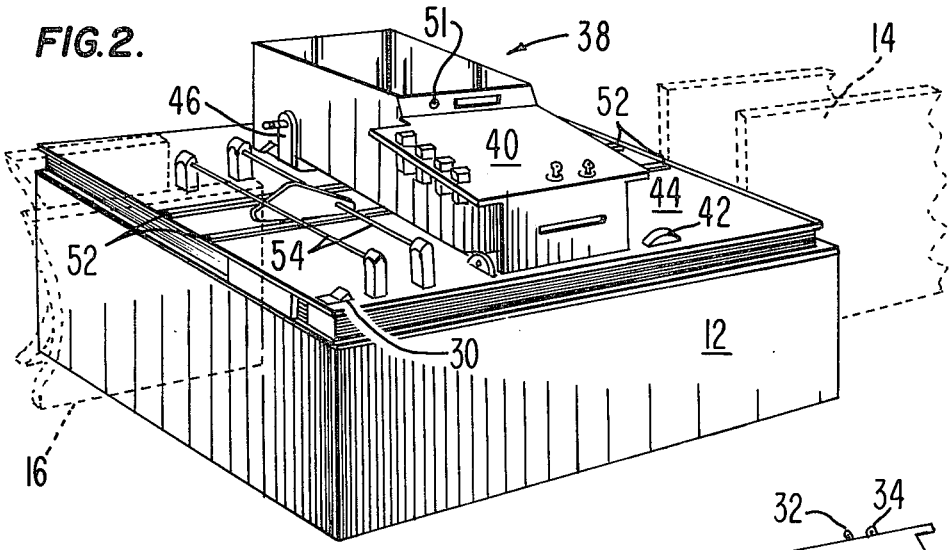
FIG. 2 is a perspective view of the apparatus of FIG. 1 with the external cover removed illustrating the control panel cover, key locks, and ribbon mechanism.
Figure 3:
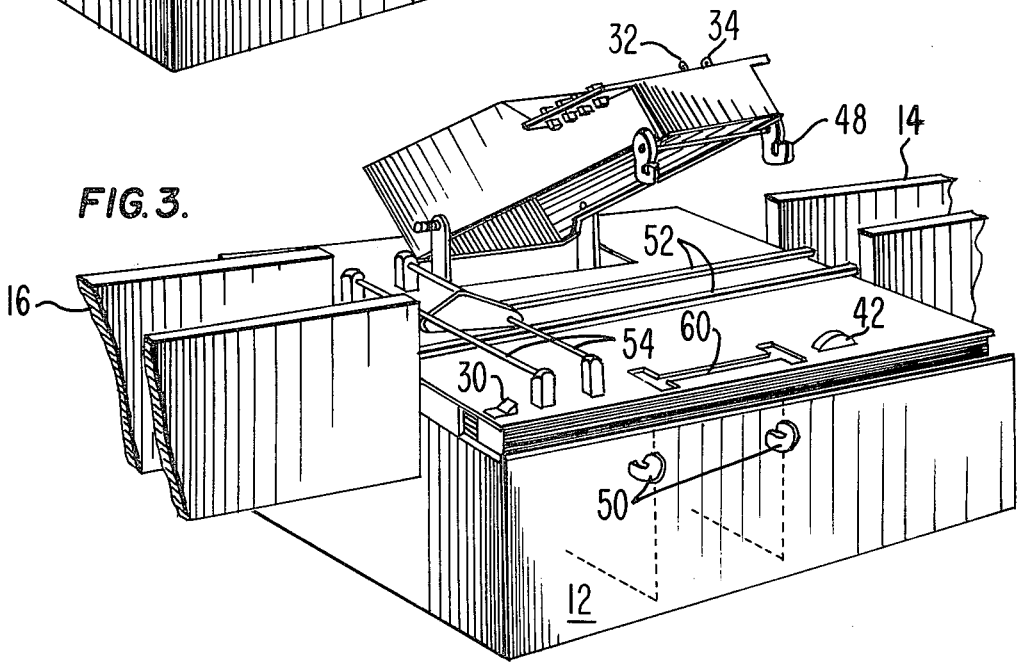
FIG. 3 is a perspective view of the apparatus of FIG. 2 with the ribbon advance mechanism in the raised position offering access to the item transport pathway.

FIGS. 1, 2 and 3 illustrate in perspective views the apparatus of the present invention. The High Speed Signer 10 is seen to include a base member 12 supporting at opposite sides thereof an input hopper 14 and an output hopper 16. The members 14 and 16 are demountably attached to the base 12 by means of guide rails or channels 18 extending from front to rear of the base 12 along the upper side portion thereof. A lightweight external cover member 20 of Fiberglas or other similar material is hingedly attached to the rear portion of the base 12 and overlies the base as seen in FIG. 1.

Located along the front forwardly slanting surface of cover 20 are four push button switch actuating members 22, 24, 26 and 28 which are adapted to extend through openings in the cover for access thereto by the operator. Switch functions are identified from top to bottom as follows:

1. Manual (22)
2. Single Feed (24)
3. Continuous Feed (26)
4. Stop (28)

These switches enable the operator to manually feed, single feed, continuous feed or stop the feeding of the items altogether. A main motor control "on-off" switch 30, FIG. 2, is located on the front of the base member 12 and controls the energization of the main driving motor from the electrical power mains (not shown).

The signer is adapted to utilize an engraved or other similar type of signature and dating plate. These plates necessarily must be maintained under rigid security since the signature of the person authorized to sign the item when applied to the item by the machine validates the item and makes it legal tender in the financial community. To offset and guard against inadvertent, accidental, or negligent access to the signature plate when demountably secured in the apparatus the machine is provided with two key locks 32 and 34 controlled respectively by the "operator" and the "supervisor" of the operator.

An elapsed-count item counter 36 is viewable through an aperture in the upper front portion of cover 20. This provides the operator with a means for continuously monitoring the number of items which have been signed and/or dated by the apparatus.

As seen in FIG. 2, removal of cover member 20 exposes the ribbon advance mechanism 38 to view. A rigid shroud or cover 40 encloses mechanism 38 which includes there within the demountable signature plate and the incremental date mechanism to be described later on herein. A control knob or thumb wheel 42 for the item stop adjustment, also to be described later on herein, is arranged for easy access to the operator through aperture in cover 44.

The ribbon advance mechanism 38 is attached, as by hinges 46, to the rear of the base 12 so as to be arcuately, vertically movable to the open position shown in FIG. 3. The mechanism 38 is counterbalanced and spring loaded by springs and is secured and locked to the base 12 when in the lowered operative position by means of oppositely disposed L-shaped members 48 which are adapted to be received over and to hook around oppositely disposed block members 50 located in base 12. An "on" condition and "end of ribbon" indicator light 51 is provided and is positioned on the shroud 40 to be viewable by the operator as will be described subsequently herein.

Figure 4:
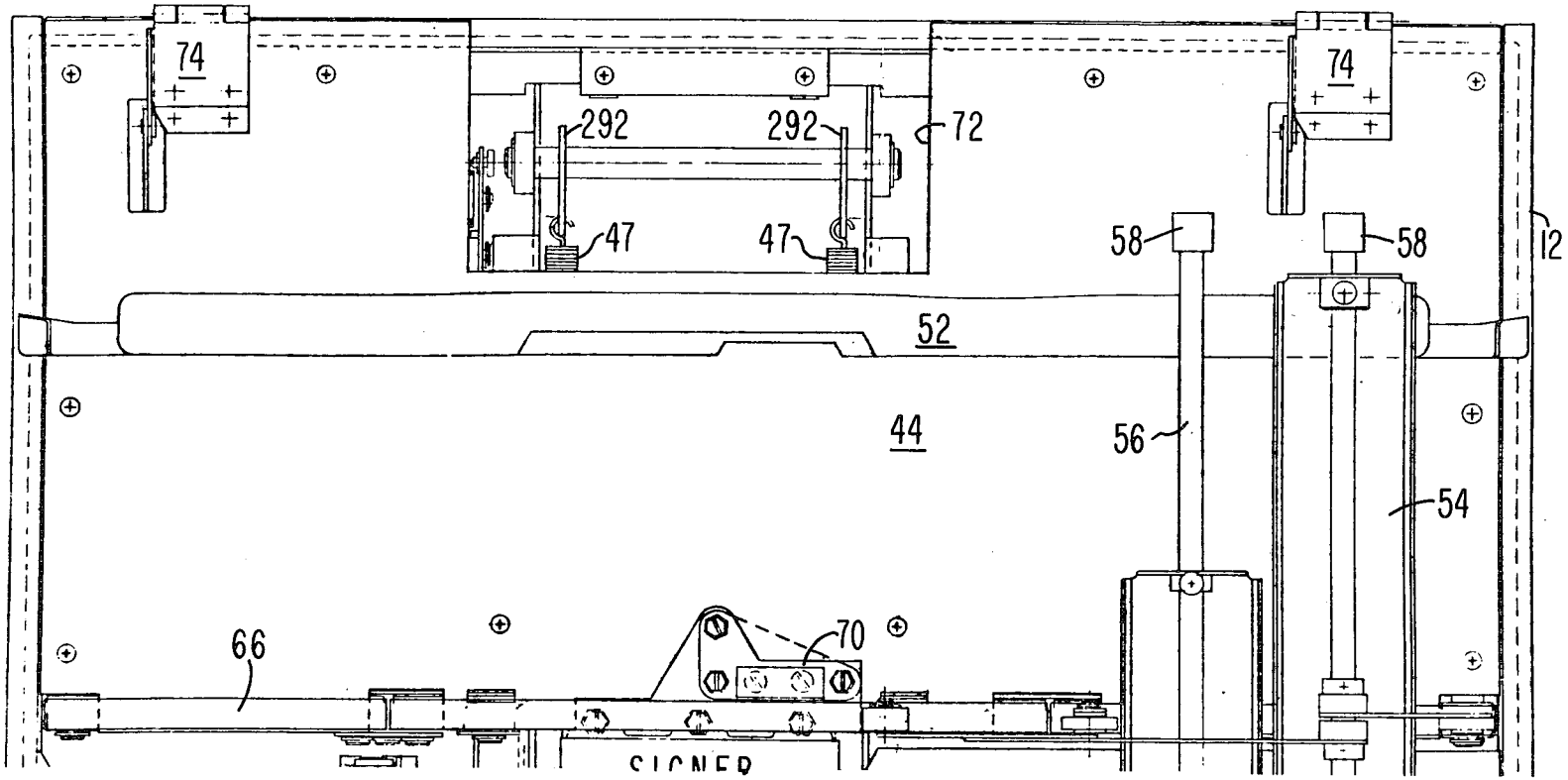
FIGS. 4 and 5 taken together constitute a top plan view of the present invention with the ribbon advance mechanism and the sheet metal shroud dismounted but with the top dust covers in place.
Figures 5, 5A:
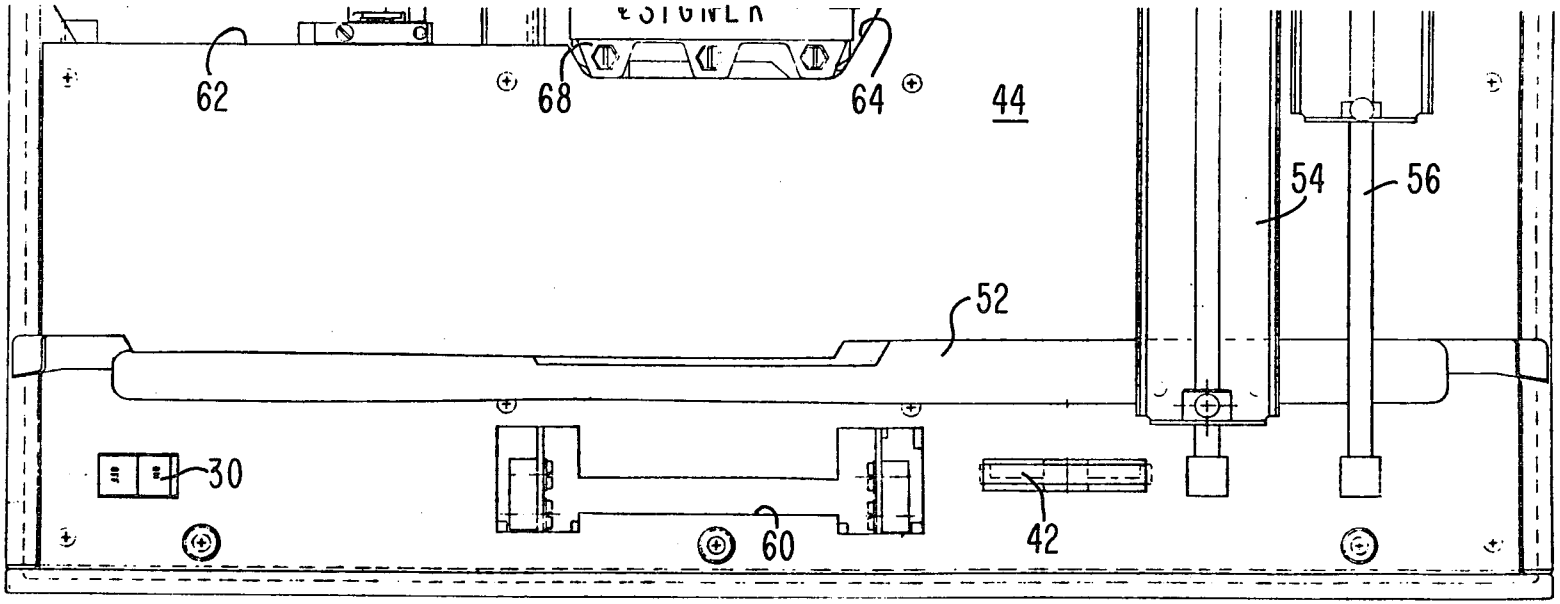
FIG. 5A is a diagram showing the manner of assembly of FIG. 4 and FIG. 5 to provide a complete view of the apparatus.

In order to accommodate items of various widths oppositely disposed slot-like guide rails 52, arranged to extend from one side to the other of the base 12, are adjustably, laterally positionable by means of the carrier members 54, FIGS. 4 and 5, to which they are attached and which slide transversely along guide rail support rods 56. The guide rails supported by the rods are positioned by means of the stand posts 58 attached to dust covers 44 and thus are demountable upon removal of the top cover 20 and dust covers 44.

As seen in FIGS. 4 and 5, which together constitute a top plan view of the embodiment of the present invention, the covers 44 which may be fabricated of sheet metal are generally rectangular in configuration and are attached to the base by means of screws. Irregularly shaped cutout portion 60, FIG. 5, permits the ribbon mechanism locking tabs 48 to be received there through so as to lock the tabs to the rigid members 50. The rear edge 62 of front cover 44, FIG. 5, is irregularly shaped to provide an access opening 64 for both the endless drive belt 66 (the operation of which will be described shortly) and the signature and dating platens 68 and 70.

The rear edge portion of rear cover 44 is provided with a rectangular cutout 72 for the hinge and base spring arrangement employed with the ribbon mechanism 38. The external "Fiberglas" cover 20 is demountably hingedly attached to the base 12 by means of the hinges 74, FIG. 4. The motor main control switch 30 is located at the lower left corner of the base member as seen in FIG. 5. To the right of the opening 60 is the item stop control thumb wheel or knob 42, the operation of which will be discussed later on herein.

Figure 6:
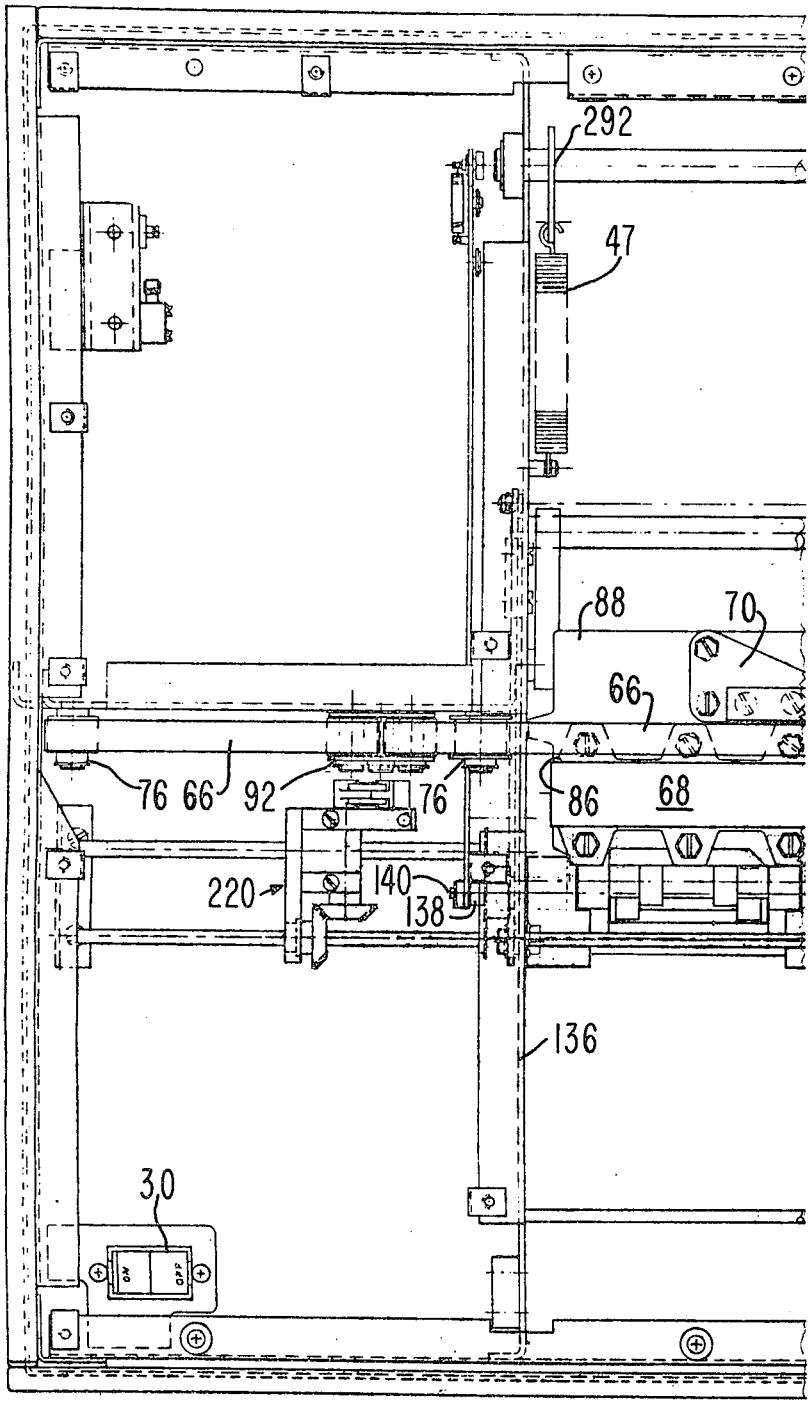
FIGS. 6 and 7 taken together constitute a top plan view of the mechanism of FIGS. 4 and 5 with the top dust covers removed.
Figures 7, 7A:
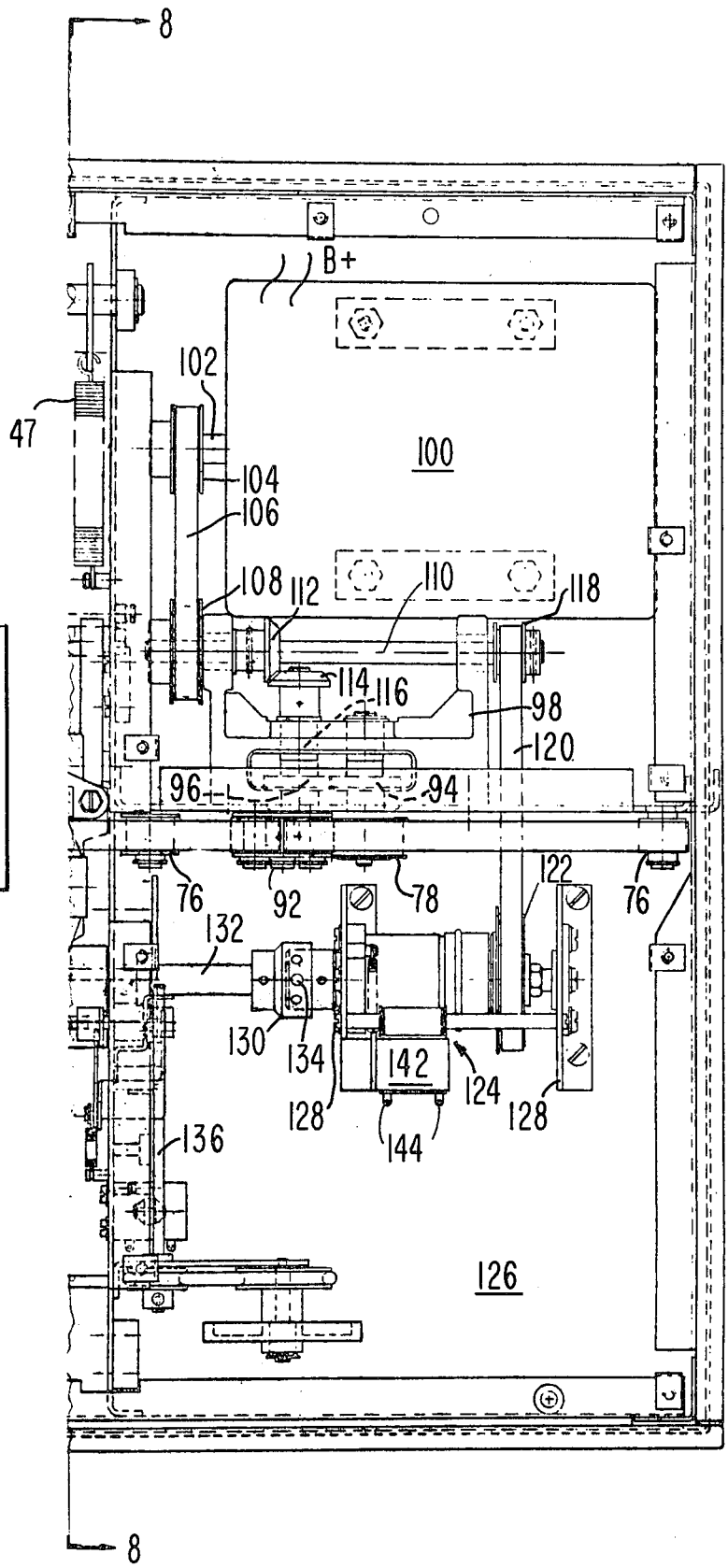
FIG. 7A is a diagram showing the manner of assembly of FIG. 6 and FIG. 7 to provide a complete view of the apparatus.

FIGS. 6 and 7, together constitute a top plan view of the apparatus of the present invention with the covers 44 removed to expose the item drive and control mechanism located therebeneath. Drive belt 66 which is a continuous loop member is carried by a series of idler rollers 76 and is driven by roller 78, seen most clearly in FIG. 9. As shown, the drive belt is maintained under suitable tension by means of tension roller 80 mounted for pivotal movement on arm 82 under tension of spring 84. The item drive belt is adapted to pass between the signature platen 68 and the date platen 70. A sufficient clearance is provided by the recessed area 86, FIGS. 6 and 8, forming a channel in the platen support member 88 so that when the platen 68 is brought into engagement with an inking ribbon member not shown in a manner to be described later on herein, the belt does not interfere.

Figure 9:
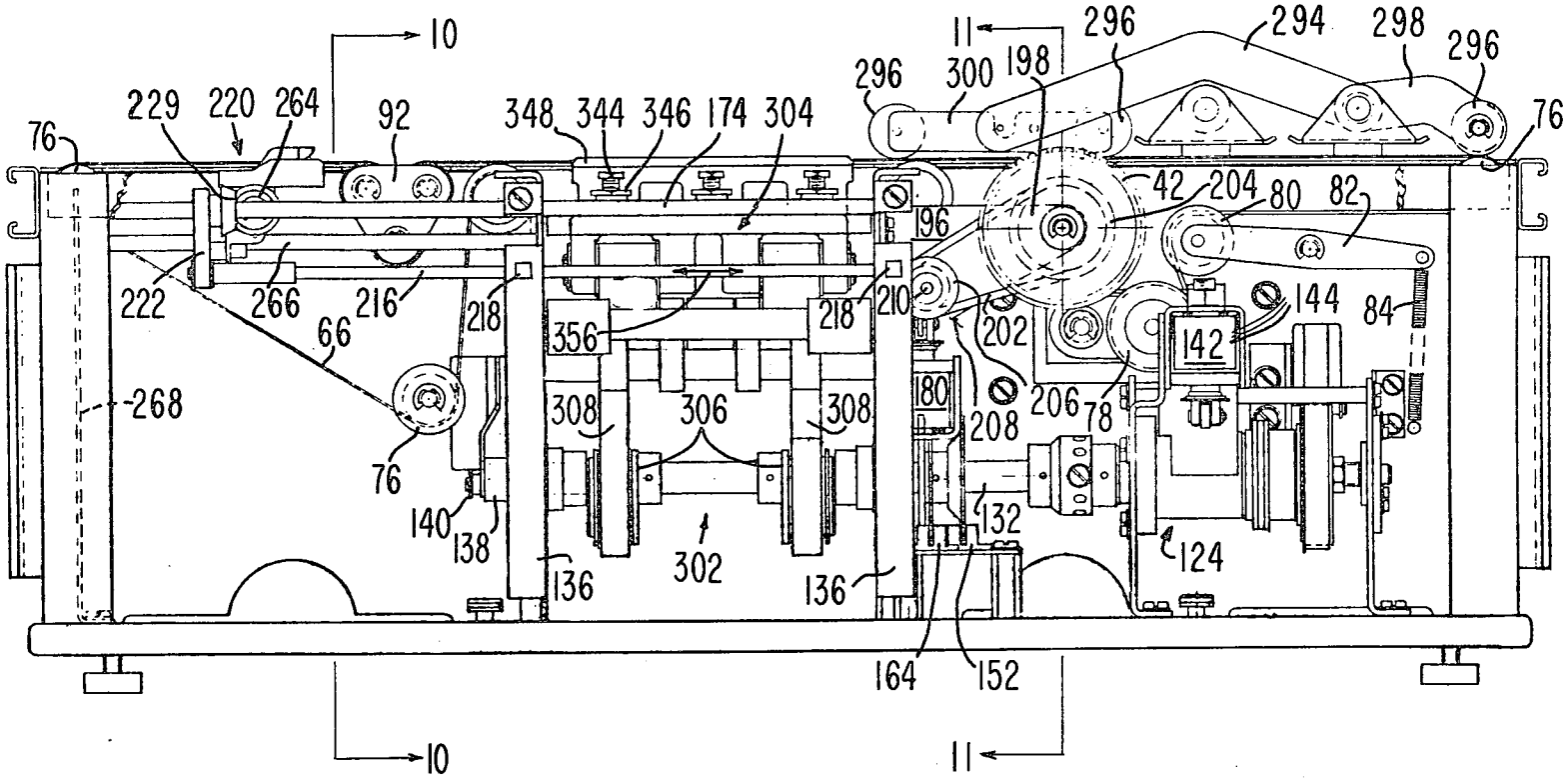
FIG. 9 is a front elevational view of the apparatus of FIGS. 4 and 5 with the front cover removed.

In order to prevent the belt from wandering from right to left during during its lengthy passage from one side of the base member to the other the belt is obliged to pass through two sets of three triangularly arranged tension rollers 92 FIGS. 6, 7 and 9 located at opposite sides of the platen support member. These rollers act to keep the belt running in a straight line without deflecting either vertically or horizontally. Drive means for the item drive belt is provided through reduction gears 94 and 96 arranged for rotation in gear block support 98. Main drive motor 100 FIG. 7 energized through main switch 30 from a suitable source of electrical potential (B+) provides rotative torque through shaft 102, pulley 104, drive belt 106, and pulley 108. The horizontal drive shaft 110 FIG. 7 driven by pulley 108 is rotatably mounted to gear block support 98. Bevel gears 112 and 114 transmit rotative drive to main item belt drive pulley 78 through shaft 116. The outboard end of shaft 110 carries a pulley 118, coupling drive belt 120 to pulley 122 FIG. 7 on high speed clutch mechanism 124. Clutch 124 is substantially identical to that described and claimed in U.S. Pat. No. 3,802,540 in the name of Preston et al, assigned to the same assignee as the present invention. Clutch 124 is rigidly attached to and supported on the bottom plate 126 of the base 12 by means of rigid vertical supports 128—128. The output drive shaft of clutch 124 is connected through clutch coupling 130 to main item signer drive shaft 132 by means of demountable adjustably positionable drive pin 134. Drive shaft 132, which is supported throughout its length, extends horizontally through vertical separator and wall support members 136—136, terminating in a bushing 138 and E ring 140, FIG. 9, for purposes to be described later on herein.

Clutch actuating solenoid 142, energized over lines 144, controlled in a manner to be described presently herein, permits the clutch 124 to be cycled in accordance with the input feed operation of the present signer apparatus.

Figure 11:
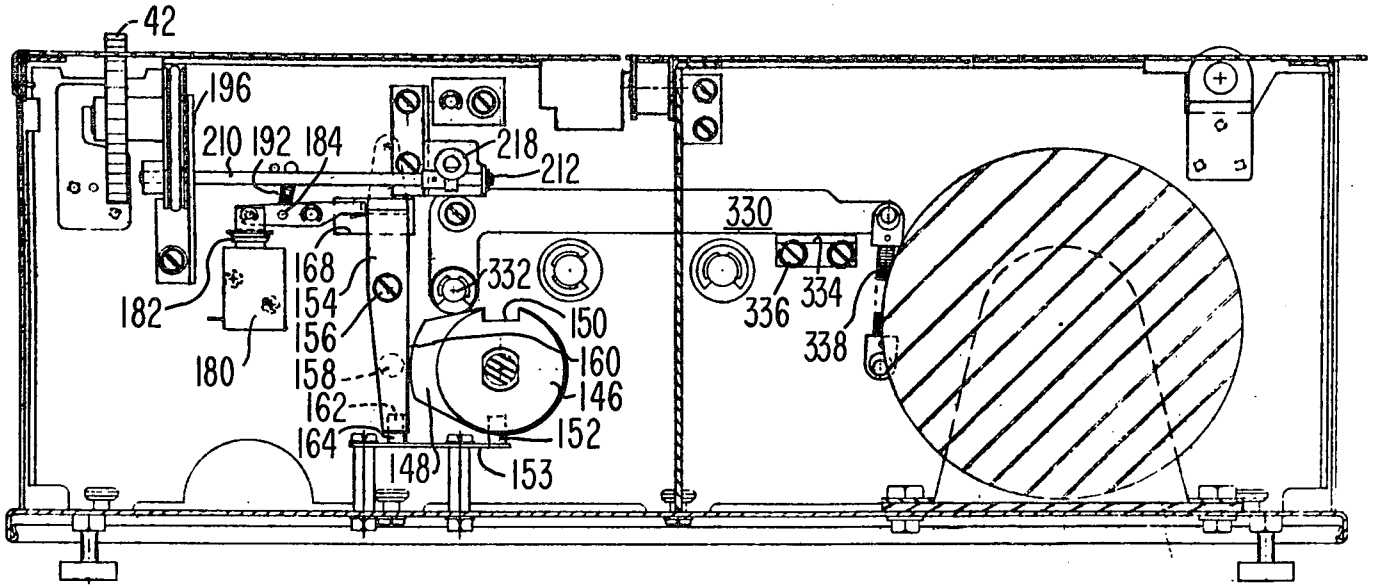
FIG. 11 is a view taken along the line 11 — 11 of FIG. 9.
Figure 10:
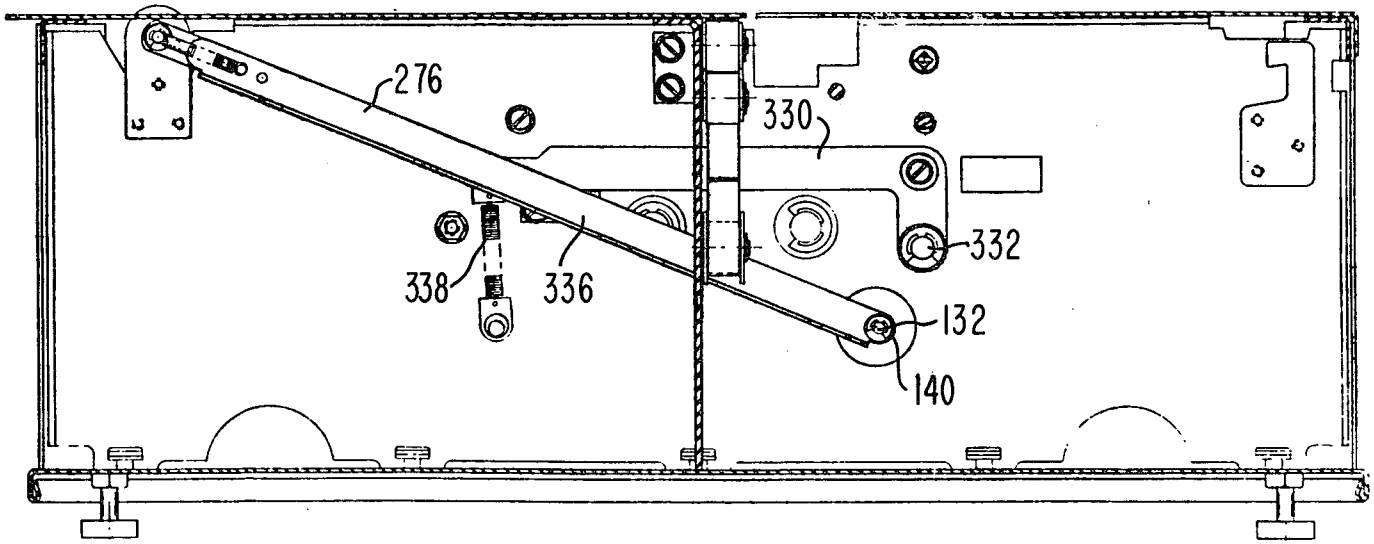
FIG. 10 is a view taken along the line 10 — 10 of FIG. 9.
Figure 15:
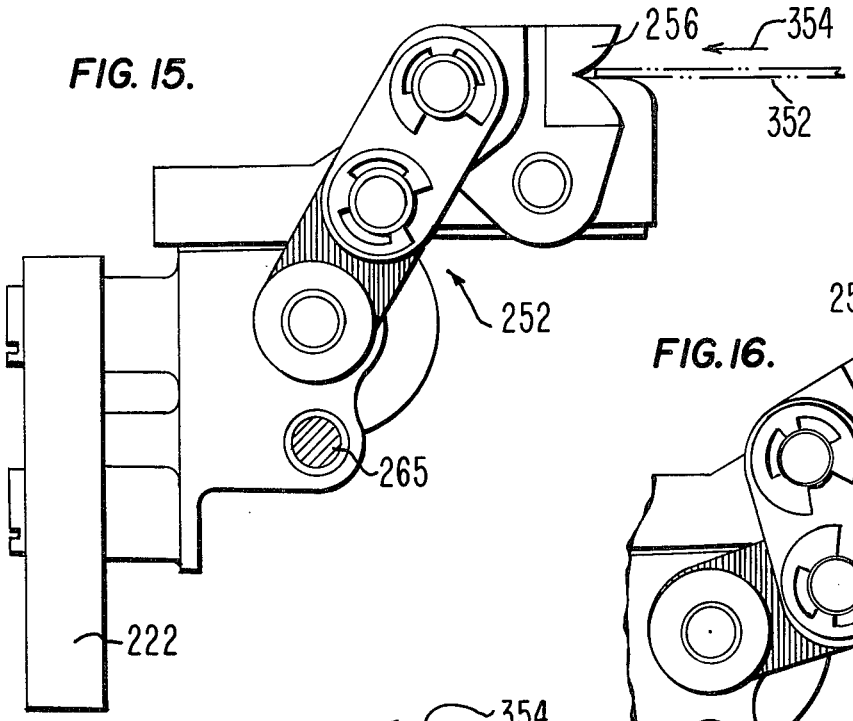
FIGS. 15 through 18, inclusive, are motion views of the item stop mechanism of FIGS. 12 through 14, inclusive, illustrating the movement from the fully advanced to the fully retracted position.
Figure 16:
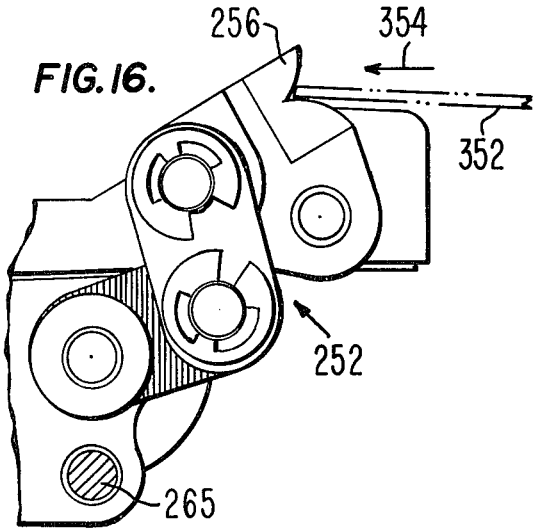
Figure 17:
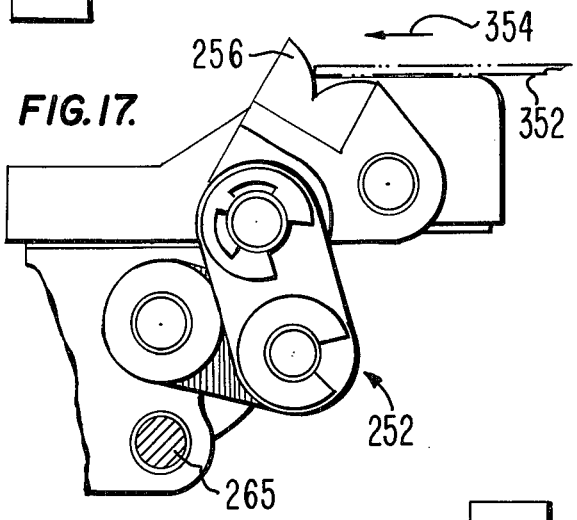
Figure 18:
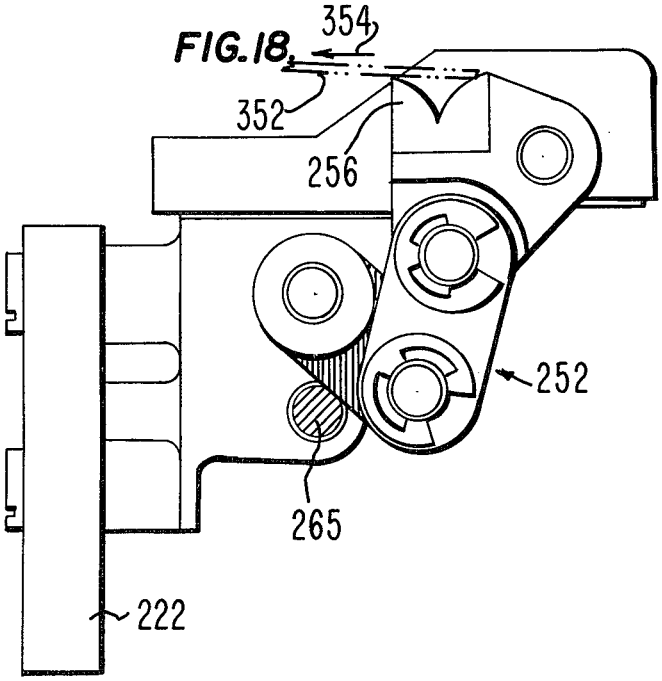

As seen most clearly in FIGS. 9, 10 and 11 of the drawing the main drive shaft 132 carries a control disk 146 and a cam member 148 FIG. 11 in parallel, spaced arrangement, secured by means of dowel pins so as to be rotatable with shaft 132 as the main drive is rotated by the drive motor 100. The periphery of control disk 146 is notched as indicated at 150 and is adapted to be rotated between the upstanding elements of photo reflective scanning control member 152 secured to a platform 153 mounted on the base plate 126 of the machine.

Adjacent to the cam and disk apparatus there is located an irregularly shaped elongated lever or link 154 pivotally mounted for rocking movement about a short horizontal stub shaft 156, FIG. 11, disposed on the wall member 136 FIG. 9. A cam follower roller 158, FIGS. 11, 11A and 11B secured to the lower depending portion of link 154 is engageable with the enlarged protuberance 160 of cam member 148 for operational movement thereby. The bottom end 162 of link 154 is adapted for rocking movement to-and-fro between the upstanding portions of photo reflective scanning control member 164 mounted on support 153 for purposes to be explained presently herein.

Figure 8:
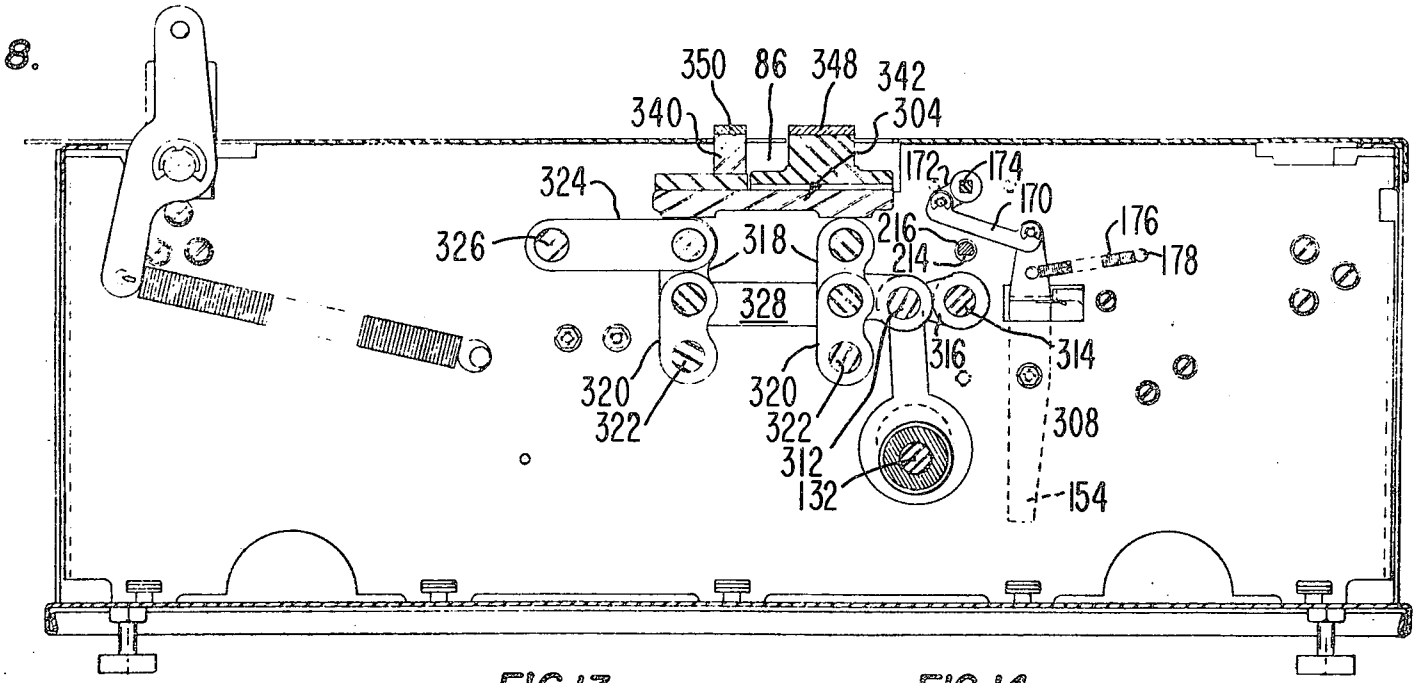
FIG. 8 is a side elevational view taken along the line 8 — 8 of FIG. 7 illustrating the platens and platen moving mechanism of the apparatus.
Figure 14:
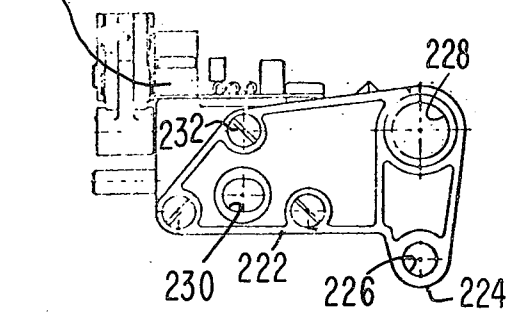
FIG. 14 is a side elevational view of the stop mechanism of FIG. 12.

The upper portion of link 154 FIG. 9 is provided with an L shaped bent portion 166 enabling this end of the link to project through a clearance slot 168 in wall member 136 so that the terminal end thereof is engageable with a cross link 170, FIG. 8, attached to the end of pivot member 172 on the end of a square shaft 174, for purposes still to be described herein. The upper end of link 154 carries a return spring 176 attached to a stud 178 in wall 136 for biasing the link 154 toward the front of the machine or in a counterclockwise direction, as viewed in FIG. 11.

To the left of link 154 and secured to the wall 136 as by bolts is a plunger type latching solenoid 180 FIGS. 11A and 11B. Plunger 182 is pivotally attached to a cross arm 184, the free end of which projects outwardly from the plunger, and, as seen most clearly in FIG. 11C, carries an L shaped bent portion 186 terminating in a tab 188. Bent portion 186 is undercut as shown in the dotted outline 190 so as to seat against the edge of bent portion 166 of the link 154 and lock the link in position as shown in FIGS. 11A, 11B and 11C. The cross arm is biased in a vertical direction by means of a spring 192 against the tension of which the solenoid plunger is caused to move when energized over lines 194, as will be described later on herein.

As earlier mentioned, the present apparatus is designed so as to accommodate varying length documents. Since the position of the printed signature on such documents must be adjustable with respect to the length thereof and also because the document must be accurately positioned and stopped in a prescribed area to receive the printing from the signature and date plates, it is necessary to provide means to adjustably locate the item stop without overburdening the operator of the apparatus with a variety of adjustments To this end the item stop mechanism of the present invention is movable or settable manually, by means now to be described, along the path of movement of the item to be signed.

Referring first to FIG. 9, a bracket 196 projecting forwardly from wall member 136 on the right side of the apparatus carries at its outboard end 198 a large knurled thumb wheel 42. A drive belt 202 engaging a large pulley wheel 204 at the rear of the shaft carrying the thumb wheel 42 transmits rotative motion to a small pulley 206 carried at the inboard end 208 of bracket 196. A short horizontal drive shaft 210, FIG. 11, journaled at one end in small pulley 206 FIG. 9 is provided with a gear 212 at the opposite end thereof engageable with the toothed lower portion 214, FIG. 8, of horizontal, adjustably movable, cross shaft 216, the latter extending from left to right across the interior front of the machine.

Cross shaft 216 is slidable from side to side of the machine in bearing members 218 attached to the wall member 136. The leftwardly extending end of cross shaft 216 is rotatably attached to item stop mechanism 220, FIGS. 6, 9 and 12 through 15 inclusive, and is secured thereto in a fashion permitting the item stop mechanism to be moved in a leftward or rightward direction along the item path of movement by means of the rotative movement of thumb wheel 42, as will be described later on herein.

Figure 12:
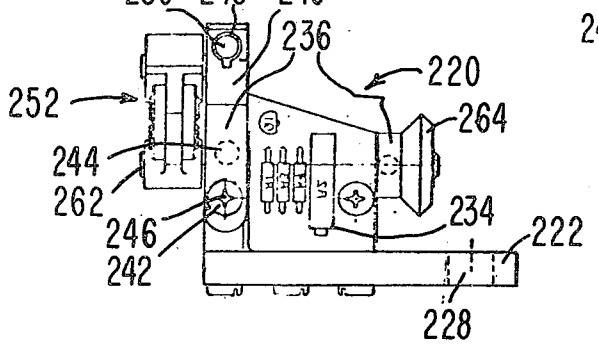
FIG. 12 is a top plan view of the item stop mechanism of the present invention.

Item stop mechanism 220, as seen most clearly in FIGS. 9, 12, 13, 14 and the motion views FIGS. 15 through 18 inclusive, comprises an irregularly shaped vertical support member 222, FIG. 12, provided with a depending projecting portion 224 at one end thereof. A pair of shaft receiving apertures 226 and 228 are arranged one above the other on the rightward portion of member 222. A lower aperture 226 extends through the portion 224. A third aperture 230 is located in the leftward portion of member 222 centrally of three attachment holes. Member 222 is secured as by bolts 232, FIG. 14, to a U shaped yoke-like shaft support member 234, FIGS. 12 and 13. An elongated mounting bracket 240 including an aperture 242 at its reduced end portion and a projecting tab or pin 244 formed integrally therewith is secured to the U shaped support as by a bolt 246 and pin 244 so as to extend outwardly away therefrom. The enlarged end of member 240 is provided with a recessed opening 248 for receiving photo reflective scanning device 250. Member 250 is a solid state detector including in one housing a photo transistor and a light emitting diode. The diode and photo transistor are angularly related such that light from the diode may be reflected to the photo transistor when an item-documented is passed over the sensor. The operation of this portion of the apparatus will be described later on herein in conjunction with the overall operation of the signer apparatus.

Figure 13:
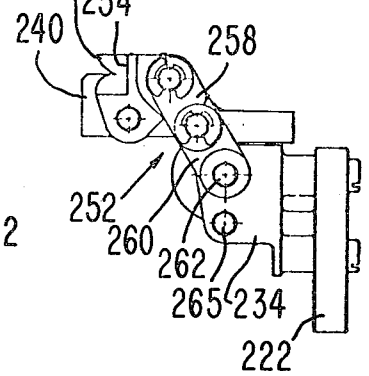
FIG. 13 is a front elevational view of the mechanism of FIG. 12.

Secured to the outboard side of the member 240 is a toggle linkage 252, FIG. 13, including an item receiving stop 254 carrying for example a flexible slightly resilient polyurethane, V-shaped element 256 thereon. Element 256 may be secured to the stop 254 as by adhesive. Intermediate toggle link 258 interconnects the stop member 254 with a drive link 260. Drive link 260 is secured to a stub shaft 262 which projects horizontally through and is journaled in the opposite portions 236—236 of the yoke member 234. Over travel limit or stop 265 prevents the linkage 260 from reaching a position from which it cannot recover. A bevel gear 264 is secured to and rotatable with the outboard end of stub shaft 262 for purposes still to be described herein.

In its assembled condition, FIG. 9, the item stop mechanism 220 is mounted on an intermediate shaft 266 extending between the inner wall bracket 136 and a vertically positioned stand-off support member 268 mounted to the base of the machine. Horizontal cross shaft 216 extends through the lower aperture 226 FIG. 14 with an E ring securing the mechanism 220 thereto. Elongated, square, rocking, drive shaft 174 projects through aperture 228 FIG. 12 and is received and secured therein by means of a square apertured bushing rotatable in the end bracket 222. Bevel gear 229 FIG. 9 carried by shaft 174 meshes with bevel gear 264 FIG. 12 and drives the same with a rocking motion for purposes still to be described.

Figure 20:
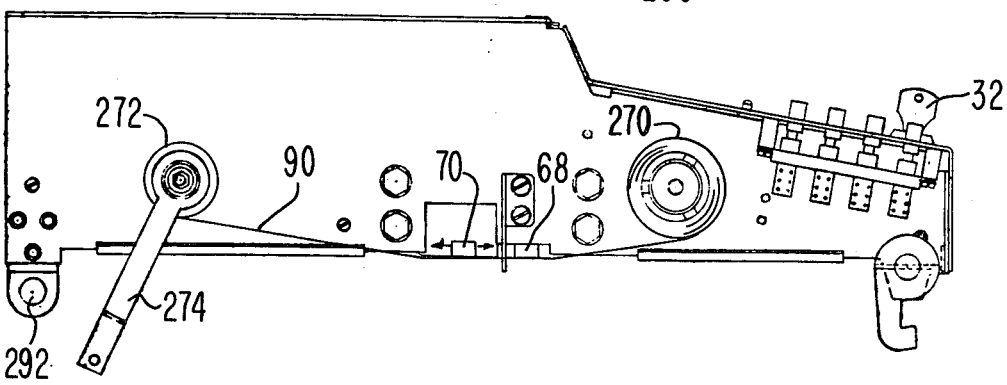
FIG. 20 is a left side elevational view partly broken away of the ribbon enclosing shroud of FIG. 16.
Figure 21:
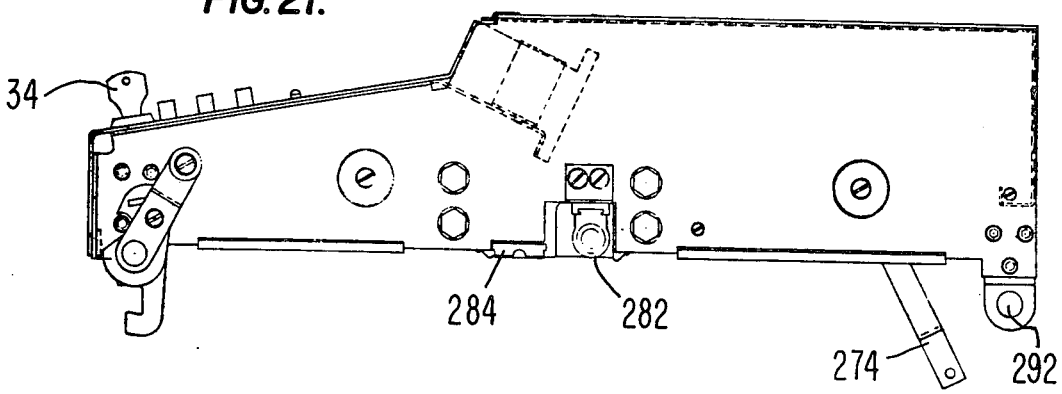
FIG. 21 is a right side elevational view of the mechanism of FIG. 16.
Figure 22:
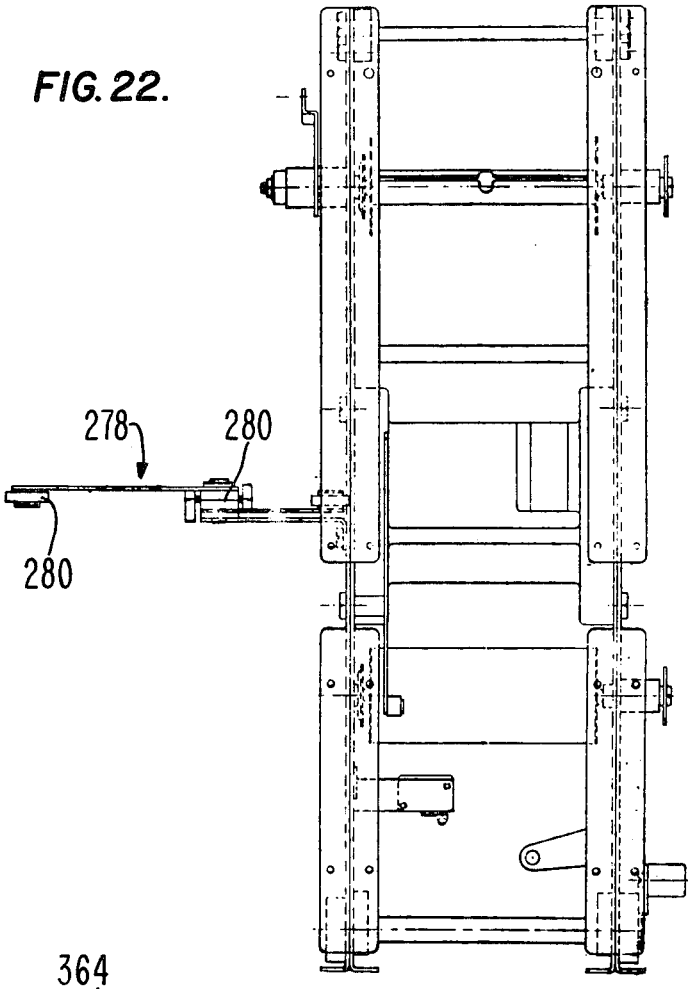
FIG. 22 is a bottom view of the ribbon advancing mechanism.

The present apparatus prints from an indexible inking ribbon 90 FIG. 20. The ribbon advance mechanism 38, as seen in FIGS. 20, 21, 23 and 24, inclusive, and which is now to be described, is adapted to cause the ribbon 90 to incrementally move adjacent the surface of the signature and date printing plates 68 and 70 respectively, from a supply reel 270 to a take-up reel 272. The means for incrementally advancing ribbon 90 includes the depending link 274 which is attached at one end to the spool carrying shaft of the take-up spool 272 and at its opposite end to an elongated rigid member 276, FIG. 10. The opposite end of member 276 is secured to the left outboard end of the main signer drive shaft 132 by means of the E ring 140. Rocking motion of shaft 132 causes link 276 to rock link 274 advancing the ribbon take-up spool 272 by one increment presenting fresh inked ribbon to the signing mechanism.

Figure 19:
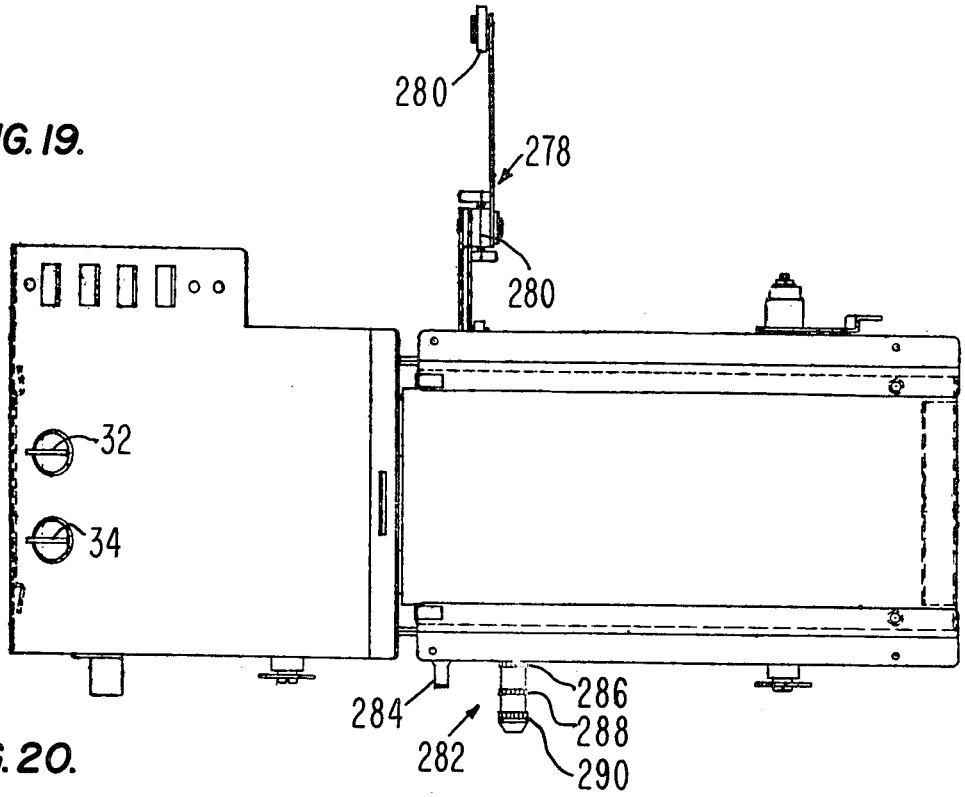
FIG. 19 is a top plan view of the ribbon advancing mechanism of the present invention including one of the outrigger hold down mechanisms.

Attached to the side of the frame of ribbon advance mechanism 38 is an outrigger assembly 278 carrying a plurality of hold down rollers 280 which ride against the endless loop belt 66 to maintain constant pressure between the belt and any item disposed therebetween as the belt travels throughout its rather considerable extent from left to right of the machine frame. Interiorly of the member 38 are two rectangular open areas for receiving the rotatably indexible date mechanism 282 and the signature plate 284. Although not shown or otherwise described in detail in FIGS. 19, 20 and 21, both of these members are slidably, demountably attached to the lower interior section of the frame 38. The date mechanism, FIG. 19, includes three rotatable assemblies 286-288-290 coaxially mounted to provide means for changing the day, date and year respectively, while the signature panel assembly itself is adapted to be removably mounted by similar means for replacement whenever the signature is changed. In operation the ribbon 90 is advanced from the supply spool 270 under the signature plate 284 and date assembly 282 to the take-up spool 272 as seen in FIG. 20. The entire assembly for advancing the ribbon 90 is a modular unitary construction which is attached to the base by means of the hinge plate assembly 292.

As previously described, the signing apparatus of the present invention is adapted to operate in a start-stop fashion wherein each item is indexed into position, stopped in such position and thereafter the signature and/or date is impressed on the document after which the document is moved immediately to its position in the outboard receiving hopper. This incremental stop-start actuation is accomplished generally by means of the clutch heretofore described, through the main drive shaft 132. Rotative motion is applied concurrently to the item stop member 220 and the ribbon advance mechanism 38 so that the complete signing and dating is a simultaneous concurrent operation at extremely high speed. The continuously moving flexible endless drive belt 66 for moving the document is maintained in its flat elongate condition by means of additional hold down members as seen more particularly in FIG. 9 wherein the outrigger assembly 294 includes a series of rollers 296 rotatably mounted on interlinked arms 298 and 300 attached to the main link 294.

The signature for the documents hereinabove discussed makes such item a valid and negotiable instrument of exchange. The signature of necessity must therefore be impressed on the document in a manner such that it is completely and clearly legible and readable throughout its extent. To this end a novel platen moving mechanism 302 is provided which causes the platen assembly 304 to be elevated and lowered through a horizontal path of movement effectively providing uniform and substantially equal pressure on the signature panel from one end to the other thereof without the problem of tilt or wobble which is sometimes encountered with known high speed printing mechanisms.

As seen particularly in FIG. 9 of the drawing but with reference also to FIGS. 8, 10 and 11 thereof, main drive shaft 132 is provided with a pair of eccentric members 306—306 which are rotatably mounted within oppositely disposed connecting rods 308 mounted for rotation on shaft 132 between the upstanding separator members 136—136. The outer ends of connecting rods 308 are linked to cross shaft 312 (shown in FIG. 8 with the eccentric at its high point) so that shaft 312 is nearly in line with shaft 314. Link 316 interconnects shafts 312 and 314.

Platen support member 304 is secured to and movable vertically, upwardly and downwardly by means of links 318—318 which are pivoted to and movable with secondary links 320—320. The upper ends of links 320 are arcuately movable about pivot shafts 322 which are rockably secured to wall support members 136—136. Oppositely disposed secondary drag links 324 is rockably pivoted at its forward end to the rearward portion of platen support member 304 while at its opposite end the links 324 are pivoted to shaft 326 rockably secured at opposite ends to the opposite separator wall members 136. A cross link 328 joins the two linkages 318–320 together for conjoint movement.

As seen most clearly in FIGS. 10 and 11 horizontal L-shaped members 330 only of which is shown in FIG. 10 disposed front to back in the machine are pivoted to cross shaft 332 and rockable thereabout. Cross shaft 332 is secured in enlarged apertures in the wall members 136 so as to have approximately ⅛ inch play thereinproviding for automatic pressure control and relief due to change in document thickness as will be described shortly herein. The opposite end of each member 330 rests on an individual stop blocks 336 secured in the opposite side frames 136. Each member 330 is biased in a downward direction, i.e. toward the bottom plate of the apparatus by means of tension springs 338.

Platen support member 304, FIGS. 8 and 9, is provided with adjustable platen carrier members 340 and 342 FIG. 8, each of which is horizontally and vertically, adjustably, positionable by means of bolts and sleeves 344 and 346, respectively, as seen particularly in FIG. 9 with respect to the signature plate platen assembly. A polyurethane platen 348 and 350 is disposed on respective platen carriers for the signature platen and the date assembly. These platen members are employed as the back-up member for the signature plate and date plate mechanism carried by the ribbon actuating and advancing mechanism.

DESCRIPTION OF OPERATION

As earlier described herein the apparatus embodying the present invention is capable of operating with the item feed input from the left hand or the right hand side of the machine depending upon the desired configuration and the type of document which is being employed therewith. For the present discussion it is assumed that the document utilizes a right hand stub and therefore the input to the machine is from the right hand side. In this instance then the stack of items would be placed in the input hopper 14 on the right side of the machine with the output hopper 16 attached as shown in FIG. 1 to the left side of the machine.

With the machine in condition shown in FIG. 1 with the covers in place and with the main motor switch 30 in the on position and the switch 26 on motor 100 is energized and the drive belt is continuously moving. As noted in connection with the description of the clutch 124 in the Preston U.S. Pat. No. 3,802,540, until clutch solenoid 142 is energized clutch pulley 122 simply cycles without operation of the clutch and therefore drive shaft 132 is immobilized.

Assuming that the continuous item feed switch has been depressed and that the feed operation is initiated, an item 352 will be forwarded from the input feed hopper by the continuously moving drive belt 66 within the guides 52 (which have been adjusted to the correct width for the particular document) along the path of travel of the belt in the direction of arrow 354, FIGS. 15 through 18, inclusive, until the leading edge of the document abuts and is entrapped by the V-shaped notch of the member 256 which is disposed in the position shown in FIGS. 4, 5, 6, 7 and 13 respectively. As the document abuts member 256 it covers phototransistor 250. As earlier described the photo sensor is adapted to operate in a reflected light mode in which light from the diode is reflected by the surface of the document back to the photo transistor causing photo detector 250 to send a pulse over lines (not shown) to the clutch solenoid 142 causing the clutch to release the stop collar rotating main drive shaft 132.

As the main shaft 132, FIG. 9, rotates it also rotates the two eccentrics 306. This action moves connecting rods 308 vertically, upwardly. The vertical motion of the connecting rods 308 causes the platen actuating mechanism to move the platen support 304 carrying the two polyurethane platen members 348 and 350 upwardly into contact with the etched signature plate 284 and the dater plate 282. With the item 352 disposed between the ribbon 90 and the members 282 and 284, printing of the signature and the date on the item is automatically accomplished.

Continued rotation of the main drive shaft 132 carrying control disk 146 and latching control cam 148 rotates these members from the position shown in FIG. 11A (with the notch 150 positioned to unblock photo transistor 152 and with latch control link 154 to the right and unblocking photo transistor 164) to the position shown in FIG. 11B where the disk lobe blocks photo transistor 152 disabling the machine printing and preventing any spurious or accidental tripping of the drive clutch 124 until the present printing operation is completed. The document counter 36 is energized to add one count to the total in the counter.

After approximately 100 degrees of rotation cam 148 brings cam lobe 160 riding on follower 158 into position to move link 154 leftwardly as seen in FIGS. 11A and 11B. Link 154 through links 170 and 172 shown most clearly in FIG. 8, rotates square shaft 174 causing the two intermeshed bevel gears 212 and 264 of the item stop mechanism 220 to rotate. Rotation of shaft 262 causes item stop linkage 252 to snap the end stop 254 arcuately, leftwardly as seen in FIGS. 15 through 18, inclusive, into the position shown in FIG. 18 against the stop pin 265 and downwardly out of the path of movement of the item 352.

In the position shown in FIG. 11B the link 154 has been moved by the cam lobe 160 into a position so that the bent portion 166 is engaged by the latching end 186 of the latching link of solenoid 180. It is noted that link 154 is biased in a rightward position by spring 176 so that in its latched condition it is maintained by the latch under tension of spring 176. Sensor 164 is now de-energized.

As the document 352 FIGS. 15–18 inclusive passes leftwardly to the receiving hopper 16 of the machine the trailing edge of the document uncovers the photo transistor 250 of the item stop mechanism. Energization of the photo transistor 250 causes a pulse to be sent to solenoid 180 retracting the plunger to the position shown in FIG. 11A which rocks the arm 184 about its pivot support causing the mechanism to release the link 154. Link 154 now swings rightwardly to the position of FIG. 11A so that the follower roller 158 is again in contact with the cam lobe of cam 148 resetting the latch 184. The mechanism is now in condition for the next incoming item depending upon whether the apparatus has been cycled in a single cycle operation or a continuous mode of operation.

As has been described hereinbefore, the apparatus embodying the present invention is provided with means enabling the apparatus to accommodate items of varying widths and lengths. The width adjustment is accomplished by means of the laterally movable guides 52 while the length adjustment is provided by means of the thumb wheel control 42 operating together with the 0-ring or pulley 202 and the pulley wheels 206 shaft 216 and fixed shaft 266. As seen most clearly in FIG. 9 of the drawing, rotation of the thumb wheel 42 causes the pulley wheel 206 to rotate rotating shaft 210 causing the gear 212 to rotate driving shaft 210 which is in engagement with the toothed portion of the bottom of shaft 216, rightwardly or leftwardly depending on the length of the item, in the direction of the arrow 356. In this manner the item end stop apparatus is caused to move rightwardly or leftwardly along the path of the item travel and thus accommodates the placement of the signature at various positions, as desired, on documents of different lengths. The square shaft 174 permits the item stop mechanism 220 to be rockably movable about the shaft while also providing a supporting means along which the item stop may be moved as the thumb wheel 42 is adjustably positioned.

Should the document thickness be inadvertently increased beyond that of a single thickness, the document pressure overload release mechanism prevents the platen drive apparatus from stalling the drive motor. Shaft 341 is rockable within the limits previously described herein through link 330 and stud 332. If, when the platen is raised, too much pressure is exerted thereon, shaft 314 is free to move about pivot shaft 332 restrained by spring 333. Any undue pressure will cause shaft 314 to rotate clockwise about pivot shaft 332 which is fixed in the side frames. The opposite ends of the link 330 float under the influence of spring 333 and are restrained in a downward direction by stop member 336. The restoring force caused by the spring is taken up by the urethane bumpers 334 on the stop member 336.

Figure 23:
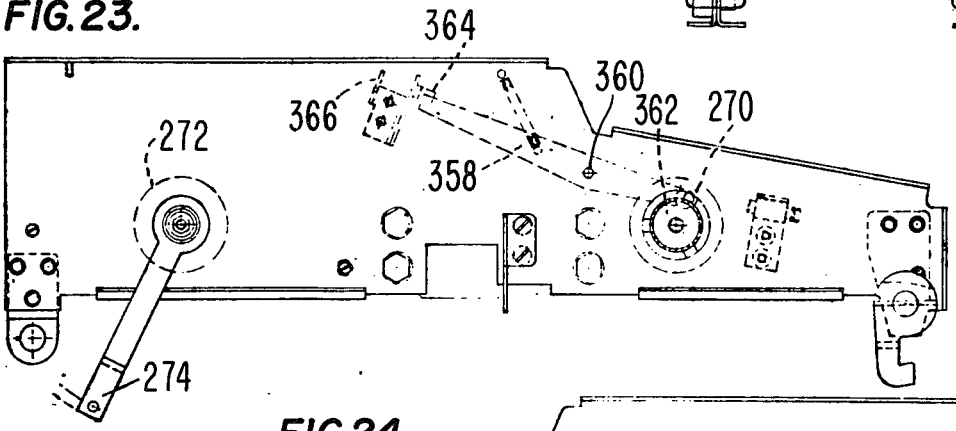
FIG. 23 is an interior left side elevational view of the mechanism of FIG. 20.
Figure 24:
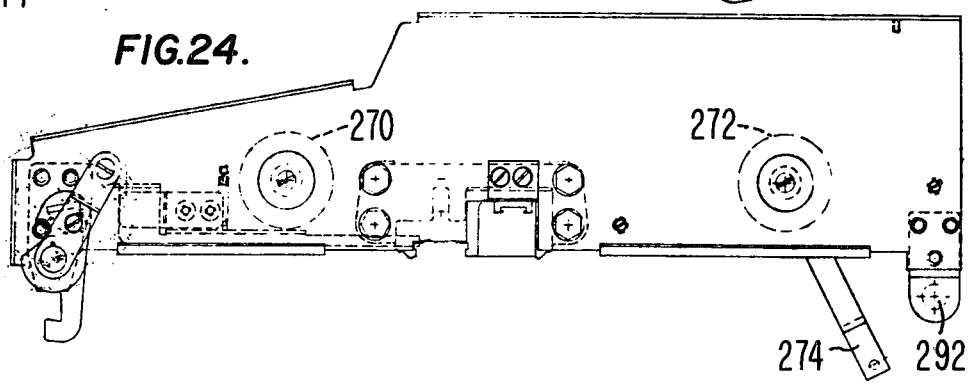
FIG. 24 is a right side view of the mechanism of FIG. 20.

As seen most clearly in FIG. 23 the ribbon advance mechanism includes supply reel 270 and take up reel or spool 272 together with a rockable elongated link 358 pivoted on a stud 360 secured to the side frame of the ribbon cover. Link 358 carries a roller 362 at the supply spool end thereof which rides on the periphery of the ribbon supply. The opposite end of link 358 is adapted to swing between the confronting surfaces of a photosensing device 364 similar to photosensors 152 and 154 shown in FIG. 11. Photosensor 364 is mounted on bracket 366 attached to the cover of the ribbon advance mechanism.

As the ribbon 90 is depleted in use, link 358 is caused to move arcuately by pivot 360 interrupting the light beam of the sensor causing the indicator light 51 on the cover to flash intermittently signaling to the operator a low ribbon condition.

What is claimed is:

1. Printing apparatus for printing signatures and dates on items effective to commercially validate such items comprising:

a printing station having a printing platen and including demountable printing members capable upon introduction of an item in juxtaposition to said platen of producing an impression of a signature and a date thereon from said printing members, input feed means for feeding items such as checks to said printing station, output collecting means for collecting items after printing, an item feed pathway including continuously movable means for moving items from said input feed means to said printing station and thence to said output collecting means, means in said printing station for causing an impression to be produced on one of said items from said signature and date impression producing members, linking means for inking said printing members including means for incrementally presenting a fresh inked area of said inking means to said signature and date impression producing members, clutch means for advancing the item moving means to present one of said items to said printing station, first photo optical sensing means producing an electrical signal for initiating and controlling the actuation of said clutch means, item stop means in said item feed pathway for stopping the item adjacent to said printing members, and second photo optical sensing means removably mounted on said item stop means, including means demountably supporting the second photo optical sensing means permitting the latter to be removed or replaced as required.

2. The invention in accordance with claim 1 wherein said means for causing an impression to be produced on an item further includes a parallelogram linkage coupled to oppositely disposed elongated link members and a pair of spring biasing members providing a resilient coupling between said platen and the impression producing means thereby maintaining both constant printing pressure at said printing station between said anvil and said printing members and providing pressure overload relief to prevent jamming and stalling due to excessive loading as a result of increases in thickness of items being printed.

3. Printing apparatus for printing signatures and dates on items effective to commercially validate such items comprising:

a printing station including demountable members capable upon introduction of an item in juxtaposition thereto of producing an impression of a signature and a date thereon, input feed means for feeding items such as checks to said printing station, output collecting means for collecting items after printing, an item feed pathway including continuously movable means for moving items from said input feed means to said printing station and thence to said output collecting means, means in said printing station for causing an impression to be produced on said items from said signature and date impression producing members, inking means for inking said printing members including means for incrementally presenting a fresh inked area of said inking means to said signature and date impression producing members, said inking means includes a ribbon supply and a photo sensing element with an indicating light actuatable in response to the depletion of the inking means for visually alerting the operator to the amount of ribbon remaining available, clutch means for advancing the item moving means to present one of said items to said printing station, photo optical sensing means producing an electrical signal for controlling the actuation of said clutch means, item stop means in said item feed pathway for stopping the item adjacent to said printing members, and photo optical sensing means removably mounted on said item stop means for initiating the feeding and printing of each of said items.

4. Printing apparatus for printing signatures and dates on items effective to commercially validate such items comprising:

a printing station including demountable members capable upon introduction of an item in juxtaposition thereto of producing an impression of a signature and a date on said items and adjustable lateral guide means for straight line guiding each item into and through said printing station, input feed means for advancing items such as checks to said printing station, output collecting means for retrieving said item from said printing station for further handling, continuously movable means for moving items along an item feed pathway from said input feed means to said printing station and thence to said collecting means, means in said printing station for causing said signature and date members to print said validating signature and date on each item, inking means for inking said printing members including means for incrementally presenting a fresh inked area of said inking means to said printing means, adjustable one way incrementally rotatable clutch means for advancing the item moving means for each cycle of operation of said apparatus, photo optical sensing means including a rotatable cam and disk controlling said clutch means, item stop means movable into and out of the item feed pathway for stopping the item adjacent to said printing means, and photo reflective photo optical sensing means removably mounted on said item stop means for initiating the feeding and printing of said signature and said date on said items.

5. The invention in accordance with claim 4 wherein said item stop means further includes means coupled thereto enabling adjustable positioning of said stop means along the path of movement of said items, means operably coupling said adjustable positioning means to said one way incrementally rotatable clutch means controlled by said photo optical sensing means effective to activate said item stop means for varying length items regardless of the item position along said item pathway.

* * * * *

UNITED STATES PATENT OFFICE

CERTIFICATE OF CORRECTION

Patent No. 4,037,535 Dated July 26, 1977

Inventor(s) Jerry Hans Lehmann et al

It is certified that error appears in the above-identified patent and that said Letters Patent are hereby corrected as shown below:

Abstract, line 11, after "Novel" insert --pressure relief apparatus permits signature imprinting pressure--.

Col. 9, line 41, should read --therein providing--.

Col. 9, line 45, after "individual" insert --polyurethane bumper 334 attached to individual--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*